US009421606B2

(12) United States Patent
Propheter-Hinckley et al.

(10) Patent No.: US 9,421,606 B2
(45) Date of Patent: Aug. 23, 2016

(54) CASTING CORES AND MANUFACTURE METHODS

(71) Applicant: United Technologies Corporation, Hartford, CT (US)

(72) Inventors: Tracy A Propheter-Hinckley, Manchester, CT (US); Eric A Hansen, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/432,790

(22) PCT Filed: Jul. 24, 2013

(86) PCT No.: PCT/US2013/051788

§ 371 (c)(1),
(2) Date: Apr. 1, 2015

(87) PCT Pub. No.: WO2014/058509

PCT Pub. Date: Apr. 17, 2014

(65) Prior Publication Data

US 2015/0251242 A1 Sep. 10, 2015

Related U.S. Application Data

(63) Continuation-in-part of application No. 13/650,419, filed on Oct. 12, 2012, now abandoned.

(51) Int. Cl.

| | |
|---|---|
| ***B22C 9/10*** | (2006.01) |
| ***B22C 9/04*** | (2006.01) |
| ***B22C 7/02*** | (2006.01) |
| ***B22C 9/22*** | (2006.01) |

(52) U.S. Cl.

CPC . *B22C 9/103* (2013.01); *B22C 7/02* (2013.01); *B22C 9/04* (2013.01); *B22C 9/10* (2013.01); *B22C 9/108* (2013.01); *B22C 9/22* (2013.01)

(58) Field of Classification Search

None

See application file for complete search history.

(56) References Cited

U.S. PATENT DOCUMENTS

| | | | |
|---|---|---|---|
| 6,637,500 | B2 | 10/2003 | Shah et al. |
| 6,929,054 | B2 | 8/2005 | Beals et al. |

(Continued)

OTHER PUBLICATIONS

International Search Report and Written Opinion for PCT/US2013/051788, dated May 9, 2014.

*Primary Examiner* — Kevin E Yoon
*Assistant Examiner* — Jacky Yuen
(74) *Attorney, Agent, or Firm* — Bachman & LaPointe, P.C.

(57) ABSTRACT

A casting core assembly (140) includes a metallic core (144, 146, 148; 360; 380; 400) and a ceramic core (142). A protuberant portion (184) of a metallic core is received in compartment (186) of the ceramic core.

23 Claims, 10 Drawing Sheets

(56) References Cited

U.S. PATENT DOCUMENTS

| | | | | |
|---|---|---|---|---|
| 7,014,424 | B2 | 3/2006 | Cunha et al. | |
| 7,134,475 | B2 | 11/2006 | Snyder et al. | |
| 7,185,695 | B1 * | 3/2007 | Santeler | B22C 7/02 164/44 |
| 7,438,527 | B2 | 10/2008 | Albert et al. | |
| 7,686,065 | B2 * | 3/2010 | Luczak | B22C 9/103 164/28 |
| 7,905,273 | B2 | 3/2011 | Dodds et al. | |
| 8,251,123 | B2 | 8/2012 | Farris et al. | |
| 8,302,668 | B1 * | 11/2012 | Bullied | B22C 9/103 164/28 |
| 2005/0274478 | A1 | 12/2005 | Verner et al. | |
| 2007/0114001 | A1 | 5/2007 | Snyder et al. | |
| 2007/0246183 | A1 | 10/2007 | Beals et al. | |
| 2008/0006384 | A1 | 1/2008 | Memmen | |
| 2008/0169412 | A1 | 7/2008 | Snyder et al. | |
| 2009/0229780 | A1 | 9/2009 | Skelley, Jr. et al. | |
| 2010/0122789 | A1 * | 5/2010 | Piggush | B22C 7/02 164/28 |
| 2011/0315336 | A1 | 12/2011 | Snyder et al. | |
| 2012/0168108 | A1 | 7/2012 | Farris et al. | |

* cited by examiner

CASTING CORES AND MANUFACTURE METHODS

U.S. GOVERNMENT RIGHTS

The invention was made with U.S. Government support under contract N00019-02-C-3003 awarded by the U.S. Navy. The U.S. Government has certain rights in the invention.

BACKGROUND

The disclosure relates to investment casting. More particularly, it relates to the formation of investment casting of cores.

Investment casting is a commonly used technique for forming metallic components having complex geometries, especially hollow components, and is used in the fabrication of superalloy gas turbine engine components. The disclosure is described in respect to the production of particular superalloy castings, however it is understood that the disclosure is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. No. 6,637,500 of Shah et al., U.S. Pat. No. 6,929,054 of Beals et al., U.S. Pat. No. 7,014,424 of Cunha et al., U.S. Pat. No. 7,134,475 of Snyder et al., U.S. Pat. No. 7,438,527 of Albert et al., and U.S. Pat. No. 8,251,123 of Farris et al.(the disclosures of which are incorporated by reference herein as if set forth at length) disclose use of ceramic and refractory metal core combinations.

SUMMARY

One aspect of the disclosure involves a casting core assembly comprising a metallic core having a thickened portion and a thin portion extending from the thickened portion. A ceramic core has a compartment in which the thickened portion is received.

In additional or alternative embodiments of any of the foregoing embodiments, a ceramic adhesive joint may be between the thickened portion and the ceramic core.

In additional or alternative embodiments of any of the foregoing embodiments, the ceramic core may be an airfoil feedcore and the metallic core is an outlet core.

In additional or alternative embodiments of any of the foregoing embodiments, the thickened portion may be of increasing thickness from a proximal end toward a distal end.

In additional or alternative embodiments of any of the foregoing embodiments, the thickened portion may have flat first and second faces.

In additional or alternative embodiments of any of the foregoing embodiments, the thickened portion may comprise a consolidated (e.g., compacted and/or sintered) metallic powder.

In additional or alternative embodiments of any of the foregoing embodiments, the thickened portion may comprise a metallic laminate.

Another aspect of the disclosure involves a pattern having an assembly of the foregoing embodiments and a wax material in which the assembly is partially embedded.

Another aspect of the disclosure involves a mold having the assembly of any of the foregoing embodiments and a shell, the metallic core having a distal portion embedded in the shell and the metallic core spanning a gap between the ceramic core and the shell.

Another aspect of the disclosure involves a process for forming the assembly of any of the foregoing embodiments. The process comprises inserting the thickened portion of the metallic core into the compartment in the ceramic core.

In additional or alternative embodiments of any of the foregoing embodiments, the methods may include securing the thickened portion to the ceramic core In additional or alternative embodiments of any of the foregoing embodiments, the securing may comprise introducing a ceramic adhesive between the thickened portion and the compartment.

In additional or alternative embodiments of any of the foregoing embodiments, the securing may comprise introducing a non-ceramic adhesive between the thickened portion and the compartment.

In additional or alternative embodiments of any of the foregoing embodiments, the methods may include applying a coating to the metallic core.

In additional or alternative embodiments of any of the foregoing embodiments, the methods may include forming the thickened portion by laminating a plurality of additional sheets to a main sheet.

In additional or alternative embodiments of any of the foregoing embodiments, the laminating may comprise welding.

In additional or alternative embodiments of any of the foregoing embodiments, the plurality of additional sheets may be asymmetrically applied to the main sheet.

In additional or alternative embodiments of any of the foregoing embodiments, the plurality of additional sheets may be symmetrically applied to the main sheet.

In additional or alternative embodiments of any of the foregoing embodiments, the methods may include machining the laminated sheets.

In additional or alternative embodiments of any of the foregoing embodiments, the methods may include forming the thickened portion by a powder process.

In additional or alternative embodiments of any of the foregoing embodiments, the powder process may comprise a laser or electron beam melting or sintering.

In additional or alternative embodiments of any of the foregoing embodiments, the metallic core may comprise a by-weight majority of one or more refractory metals.

In additional or alternative embodiments of any of the foregoing embodiments, the process may be a portion of a pattern-forming process and further comprising overmolding a main pattern-forming material to the core assembly in a pattern-forming die.

In additional or alternative embodiments of any of the foregoing embodiments, the process may be a portion of a shell-forming process, the shell-forming process further comprising shelling the pattern and removing the further sacrificial material and main pattern-forming material and hardening the shell.

In additional or alternative embodiments of any of the foregoing embodiments, the process may be a portion of a casting process, the casting process further comprising introducing molten metal to the shell, allowing the metal to solidify, and destructively removing the shell and the core assembly.

In additional or alternative embodiments of any of the foregoing embodiments, the ceramic core may form a feed passageway in an airfoil and the metallic core may form an outlet passageway from the feed passageway to a pressure side or a suction side of the airfoil.

In additional or alternative embodiments of any of the foregoing embodiments, the securing may comprise introducing a non-ceramic adhesive between the thickened portion and the compartment and the non-ceramic adhesive may be vaporized or reacted off upon the introduction of the molten metal or before.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
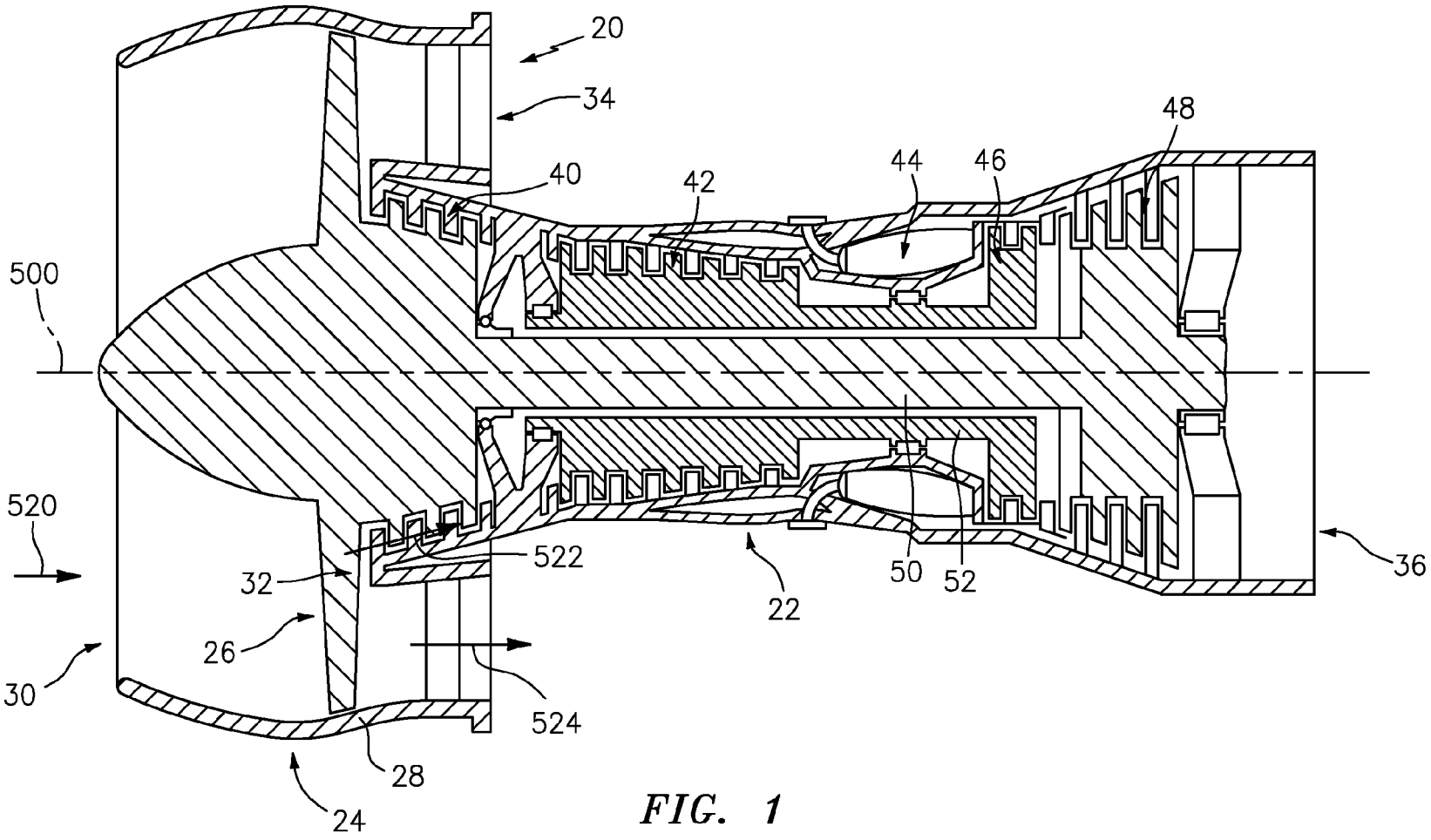
FIG. 1 is a schematized longitudinal sectional view of a turbofan engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages of fan blades 32. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also directly drives the fan. In alternative implementations, the fan may be driven via a transmission (e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 2:
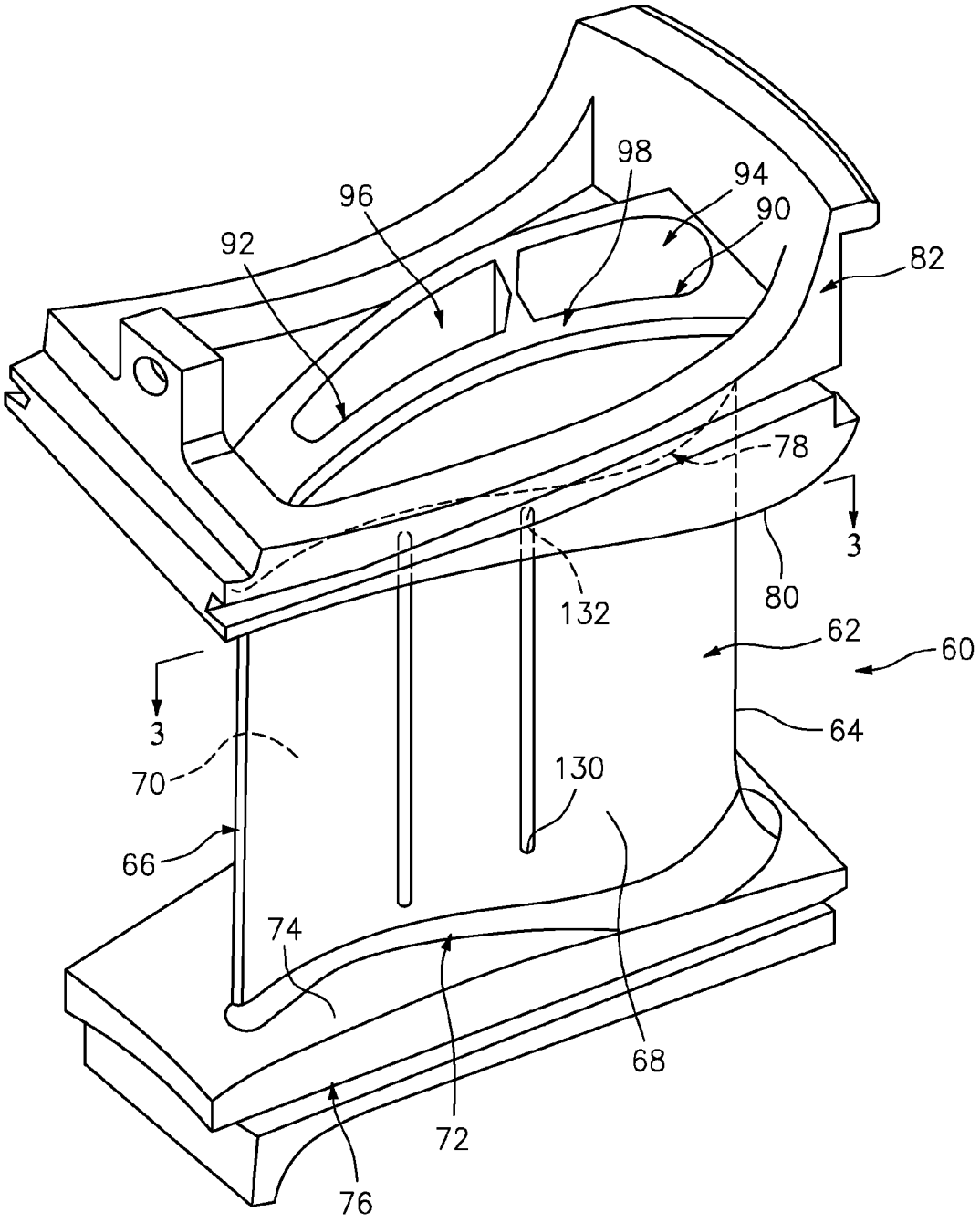
FIG. 2 is a view of a turbine vane of the engine of FIG. 1.

FIG. 2 shows an exemplary cast turbine element 60 of one of the turbine sections. The exemplary casting is of a nickel-based superalloy or a cobalt-based superalloy. The exemplary element 60 is an airfoil element such as a blade or vane, in this example, a vane. The vane comprises an airfoil 62 extending from a leading edge 64 to a trailing edge 66 and having a pressure side 68 and a suction side 70. The airfoil extends along a span from an inboard (inner diameter (ID)) end 72 along the outer (outboard) surface (gas path-facing surface) 74 of a platform 76. The airfoil extends to an outboard (outer diameter (OD)) end 78 at the inboard surface (gas path-facing surface) 80 of an outer diameter (OD) shroud 82.

Figure 3:
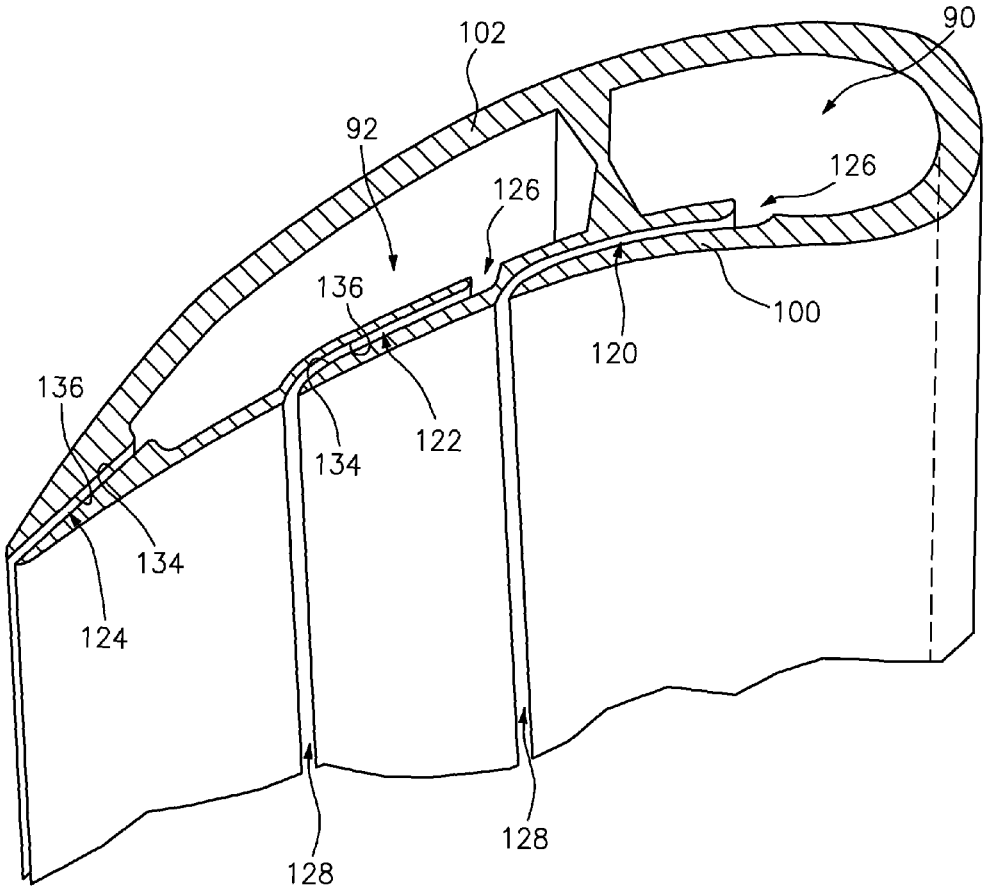
FIG. 3 is a cutaway view of the vane of FIG. 2, taken along line 3-3.

The element 60 has a passageway system for passing cooling air through the airfoil. The exemplary system includes one or more (e.g., two) passageway trunks 90, 92. Exemplary passageway trunks have inlets 94, 96 along the OD face 98 of the OD shroud 82 for receiving cooling air (e.g., air bled from the compressor(s)). FIG. 3 further shows a pressure side sidewall 100 and a suction side sidewall 102 with the legs 90 and 92 therebetween.

FIG. 3 further shows the passageway system as including a plurality of outlet (discharge) passageways 120, 122, 124 (shown slot-like) extending from one or more associated inlets 126 along one or more of the associated passageway trunks (which serve as feed passageways) 90 and 92 to one or more associated outlets 128 along the exterior surface of the airfoil. In the exemplary embodiment, the outlets of the passageways 120 and 122 are along the pressure side 68 of the airfoil and the outlet of the passageway 124 is along the trailing edge.

Spanwise, the passageways 120, 122, 124 extend from an inboard (inner diameter (ID)) end 130 to an outboard (outer diameter (OD)) end 132. The passageway inlet 126 or outlet 128 may be segmented as is known in the art. Additionally, within the passageway, various posts, pedestals, or other surface enhancements may be present.

There may be a variety of additional outlet passageways. For example, these may include pluralities of individual holes (e.g., drilled or cast) along the airfoil or along the platform or shroud. Additionally, the feed passageways 90, 92 may open to the ID face of the ID platform to deliver cooling air to further locations (or, alternatively receive cooling air if flow were reversed and there were platform inlets).

FIG. 3 further shows the outlet passageways as each having a first face 134 and a second face 136. For the passageways 120 and 122, the face 134 is generally close to the adjacent outer surface of the airfoil whereas the face 136 is close to the surface of the associated leg 90 and/or 92. For the passageway 124, the surfaces are generally respectively toward the pressure side and suction side.

Figure 4:
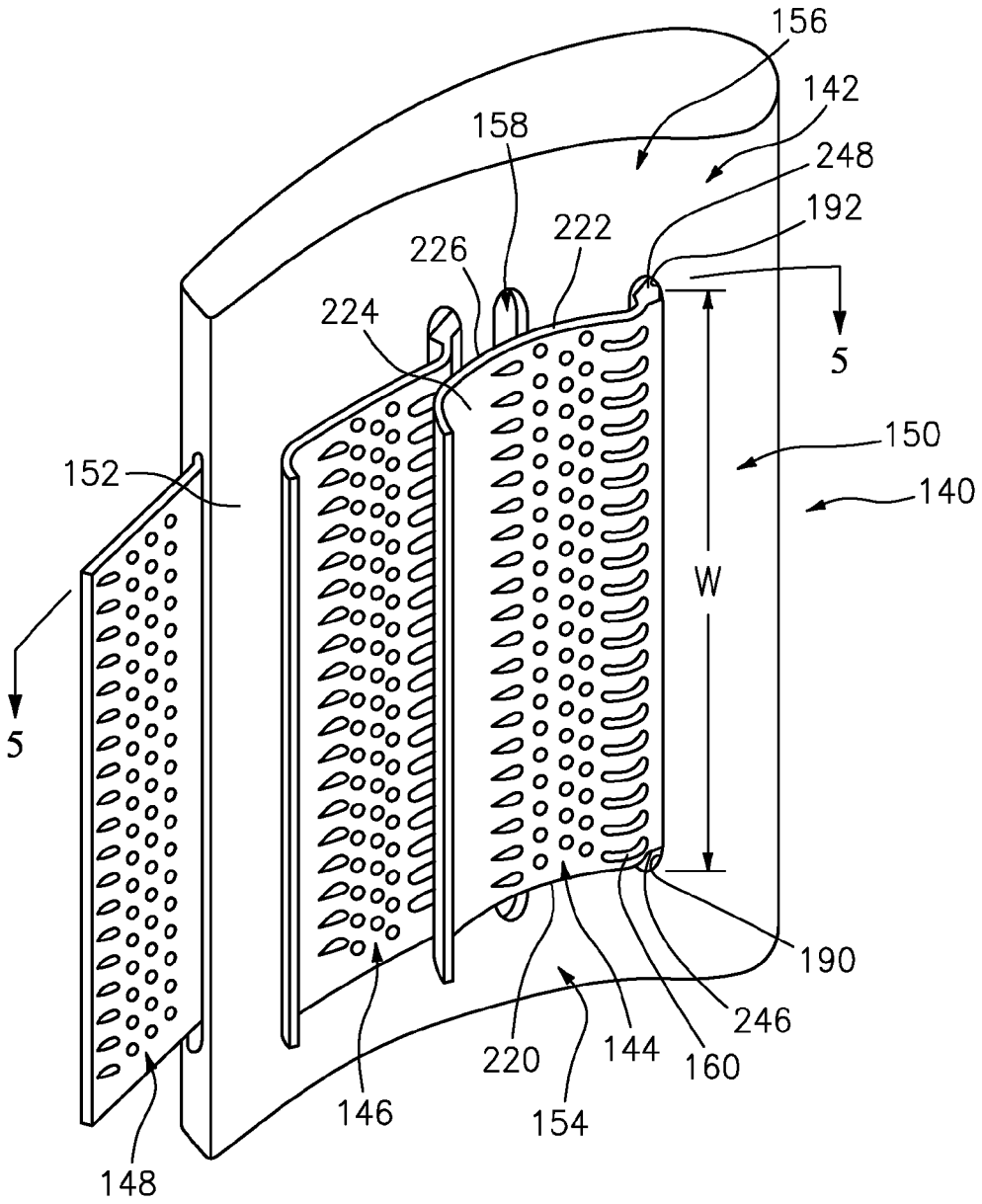
FIG. 4 is a view of a refractory metal core (RMC) and ceramic feedcore casting core assembly for forming the vane.

FIG. 4 is a view of a casting core assembly 140 for forming the vane of FIG. 2. The core assembly includes one or more ceramic feedcores 142 and one or more metallic cores 144, 146, and 148 (e.g., refractory metal cores (RMC)). Exemplary RMCs are refractory metal based (i.e., having substrates of at least fifty weight percent one or more refractory metals such as molybdenum, tungsten, niobium, or the like, optionally coated).

The exemplary feedcore 142 comprises two legs 150 and 152 respectively for casting the feed passageways 90 and 92. At respective inboard and outboard ends of the legs 150 and 152, the feedcore includes end portions 154 and 156 linking the two legs and providing mechanical integrity. Thus, a gap 158 is formed between the legs.

The exemplary RMCs 144, 146, and 148 are configured to cast the respective outlet passageways 120, 122, and 124. Each of the RMCs includes a plurality of apertures 160 of appropriate shape for casting post features in the associated outlet passageway.

Figure 5:
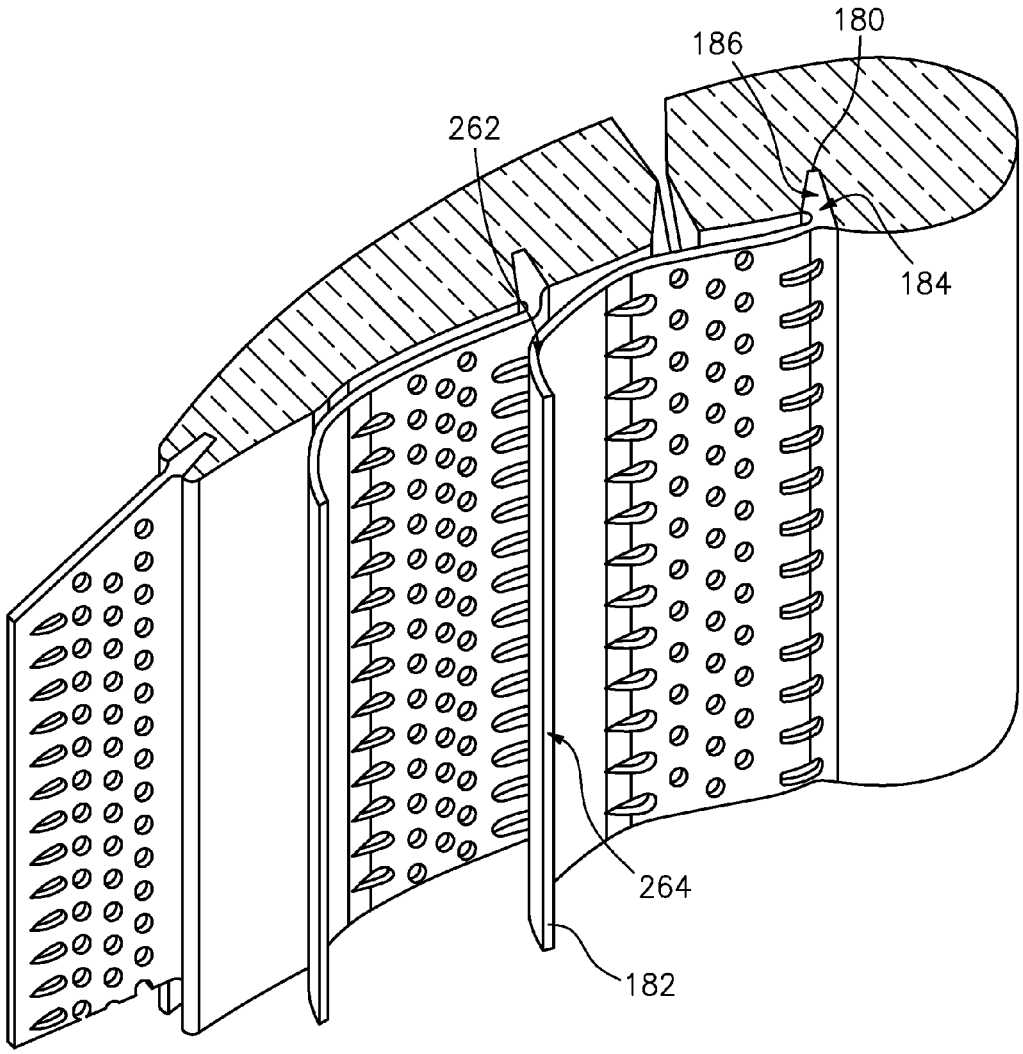
FIG. 5 is a cutaway view of the casting core assembly taken along line 5-5.

FIG. 5 shows further details of the exemplary RMCs.

Each of the RMCs extends from a proximal edge 180 to a distal edge 182. As is discussed further below, a thickened (protuberant) portion 184 near the proximal edge 180 is received in a complementary blind channel or slot (compartment) 186 of the associated leg of the ceramic core. Each exemplary slot 186 extends spanwise from a first end 190 (FIG. 4) to a second end 192. The exemplary first end 190 is an inboard/ID end and the exemplary second end 192 is an outboard/OD end. The exemplary slots 186 further include a base 194 and a pair of lateral faces or sidewalls 196 and 198 extending outward from the base 194 to a slot opening along a main surface portion 200 of the feedcore. Exemplary slots 186 are elongate, having a distance between ends 190 and 192 substantially greater than a width between faces 196 and 198 (e.g., at least five times greater, more particularly, at least ten times or 10-50 times).

The exemplary RMCs each have an inboard/ID end 220 (FIG. 4) and an outboard/OD end 222. The exemplary RMCs further include a first face 224 and a second face 226. The exemplary faces 224 and 226, along a majority portion of a streamwise length between the edges 180 and 182 respectively face away from the feedcore and face toward the feedcore.

The RMC thickened portion 184 is formed as an elongate protuberance or plug. Whereas the main portion 185 of the RMC may have a characteristic thickness T (FIG. 6), a corresponding peak thickness $T_P$ (FIG. 6) of the plug may be substantially greater. For example, a peak value of $T_P$ may be at least four times what the characteristic thickness T is (e.g., measured as a mean, median, or modal value along the portion of the RMC that forms the outlet passageway). More narrowly, exemplary peak $T_P$ may be at least five times T (e.g., 5-20 or 6-12 times). Exemplary T is 0.005-0.05 inch (0.13-1.3 mm), more narrowly, 0.25-0.64 mm. Exemplary $T_P$ is 1.0-5.0 mm at the thickest portion of the plug, more particularly, 1.5-3.0 mm or about 1.8 mm. Exemplary $T_P$ is 0.75-4.0 mm at the narrowest portion of the plug (e.g., the end 180), more particularly, 1.0-2.0 mm. Exemplary $T_P$ at the narrowest portion of the plug may be slightly greater than the RMC thickness (e.g., 0-0.5 mm greater or, more narrowly 0.05-0.1 mm). Exemplary width W of the RMC and plug is at least twice the exemplary peak $T_2$, at least five times or 5-30 times. In various examples, such width W may be at least 20 mm, more narrowly, 20-200 mm. Exemplary slot height/depth $H_1$ is at least 50% of said maximum $T_P$, more particularly, at least 100% or at least 150%, more narrowly, 150% to 500% or 200%-500%. Exemplary slot height/depth $H_1$ is 1.3-10 mm, more narrowly, 1.3-3.0 mm. Plug height $H_2$ may be an exemplary 80-120% of $H_1$, more narrowly, 90-110%.

Dimensions of the RMC main portion transverse thereto (e.g., between the ends 220 and 222 and from passageway inlet to outlet) are much greater (e.g., in excess of ten times greater, more particularly in excess of twenty times).

Figure 6:
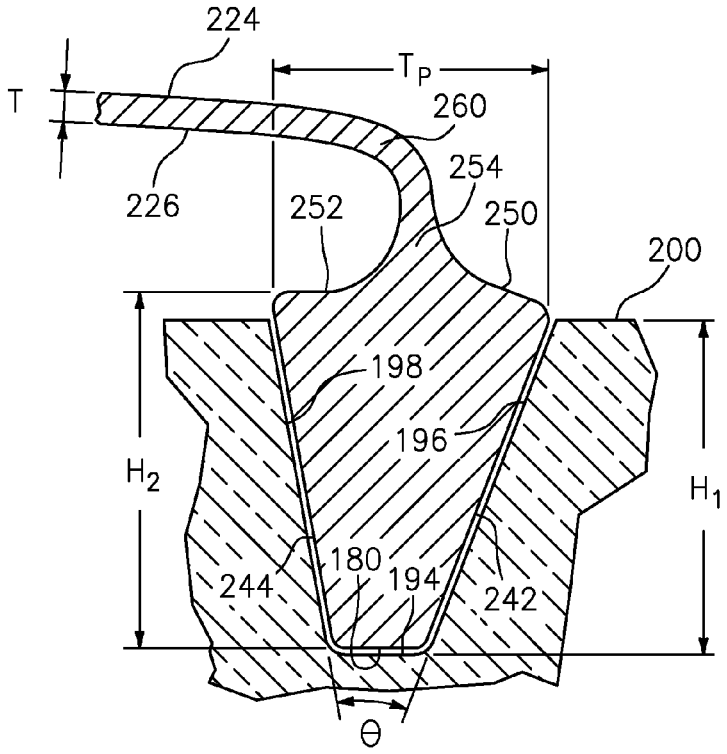
FIG. 6 is a partial sectional view of an RMC-to-feedcore joint in the core assembly.

FIG. 6 shows the exemplary plug 184 having faces 242 and 244 generally aligned with and closely facing or contacting the slot faces 196 and 198. These faces and the slot faces may be provided with a moderate taper toward the end face/facet 180 (which is in similarly close facing or contacting relation to the slot base 194). Exemplary characteristic gaps (if any) are less than 0.1 mm (e.g., mean, median, or modal). However, slight irregularities may cause similarly sized local gaps to arise even if there is no average gap. An exemplary taper angle θ is less than 40° or less than 20° (e.g., 1-15° or 2-10° or about 6°). The exemplary plug has respective inboard and outboard ends 246 and 248 which may be essentially coplanar with the ends 220 and 222 along the main portion of the RMC. These may be closely facing or contacting the slot ends 190 and 192, respectively. Thus, an exemplary plug length between these ends 246 and 248 may be much greater than T (e.g., in excess of ten times greater, or particularly in excess of twenty times greater) and in excess of five times greater than $T_P$, or particularly in excess of ten times.

FIG. 6 further shows plug shoulders 250 and 252. These shoulder surfaces merge with and form parts of the respective RMC faces 224 and 226 along a tapering neck region 254. An exemplary slot depth is shown as $H_1$. An exemplary plug height (e.g., to outboard portions of the shoulders) is shown as $H_2$.

FIG. 6 further shows a bend 260 in the RMC main portion just distally of the neck 224 and shoulders 250, 252 so as to offset the RMC main portion from the feedcore surface 200 to align the main portion within the associated wall of the ultimate casting. A similar bend 262 (FIG. 5) may transition between the main portion and an outlet end terminal portion 264 which forms the outlet of the discharge slot and becomes embedded in the shell.

An exemplary method of RMC manufacture is an additive manufacture process where the RMC is built up from a powdered refractory metal such as molybdenum or combinations noted above. A variety of known or yet-developed additive manufacturing processes may be used. Layers of powder are built-up and selectively consolidated such as via a selective laser sintering process (e.g., direct metal laser sintering (DMLS) leaving a sintered structure) or an electron beam melting process. After the final layer has been consolidated, the consolidated part may be removed from the surrounding unconsolidated material. The part may be in final form (e.g., with the bends 260 and 262 already built or the bends may later be formed). Similarly, the RMC may be pre-formed with the holes 160. The additive manufacturing process is a computer controlled process using a computer model of the RMC to build the RMC. An alternative non-additive powder process may be a powder compaction/consolidation process such as hot isostatic pressing (HIP).

The RMC may be coated with a coating (e.g., to isolate the RMC from the molten casting alloy (to protect the alloy) and prevent oxidation of the refractory metal components). A variety of coatings are known. An exemplary coating is an aluminide and/or aluminum oxide (e.g., a platinum aluminide applied via chemical vapor deposition (CVD)).

The feedcore may be pre-molded and, optionally, pre-fired. The exemplary molding involves molding a mixture of a ceramic powder and binder. The molding may compact the mixture to form a green compact. Thereafter, the core may be fired or otherwise heated to at least partially harden the core and remove the binder. Exemplary ceramic feedcore material is a fused silica with a paraffin binder injected to mold and then fired (e.g., at above 2000° F. (1093° C.)) to sinter/harden and burn off or volatize the paraffin. An alternative is a similar fused alumnia or a mixture of alumina and silica. Another alternative is a castable ceramic (e.g., silica and/or alumnina) in an aqueous or colloidal silica carrier which then dries to harden. Such material is often used as an adhesive or shell patch.

In a conventional process of inserting the upstream (inlet end) distal portion of a prior art sheet RMC into a slot in an associated trunk of the feedcore, a bead of ceramic adhesive is introduced between the RMC and slot. There is a tendency of the adhesive to wick along the RMC. This wicking may cause irregular or otherwise undesired features in the ultimate casting. Removal of the wicked material (flash) may be difficult. To address this wicking, use of a plug may control the problems of flash in one or more ways. First, even if an adhesive (e.g., ceramic slurry or slip is used in shelling) is used between the plug and the feedcore and the flash, it may be easier to remove the flash than it is to remove flash from the securing of the sheet RMC to the feedcore. The problem of such flash is discussed in U.S. Pat. No. 8,251,123 of Farris et al. For example, there may be easier physical access to regions of flash. Second, the physical presence of the shoulders 250 and the sharp transition from the sides of the plug to the shoulders may prevent or reduce the wicking or limit it to a region that does not flex and thereby is less likely to produce defects due to delamination of wicked material, etc. Third, the rounded concavity of the shoulders may provide a rounded convex shoulder of the outlet passageway inlet transitioning to the feed passageway. This may reduce stress concentrations and improve airflow. Fourth, it may be easier to more tightly tolerance the slot to reduce gaps and, thereby, reduce use of adhesive. If sufficiently tight, yet a different form of adhesive might be used. For example, a cyanoacrylate might be used to hold the plug to the feedcore. If there is very tight tolerance, even if the casting temperatures destroy such adhesive, the gaps left may be so small that metal infiltration does not occur during casting.

After assembly of the RMC to the feedcore, and after any joint between the plug and feedocore has sufficiently hardened (dried/cured) the resulting core assembly may then be transferred to a pattern-forming die. The pattern-forming die defines a compartment containing the core assembly into which a pattern-forming material is injected. The exemplary pattern-forming material may be a natural or synthetic wax.

Figure 7:
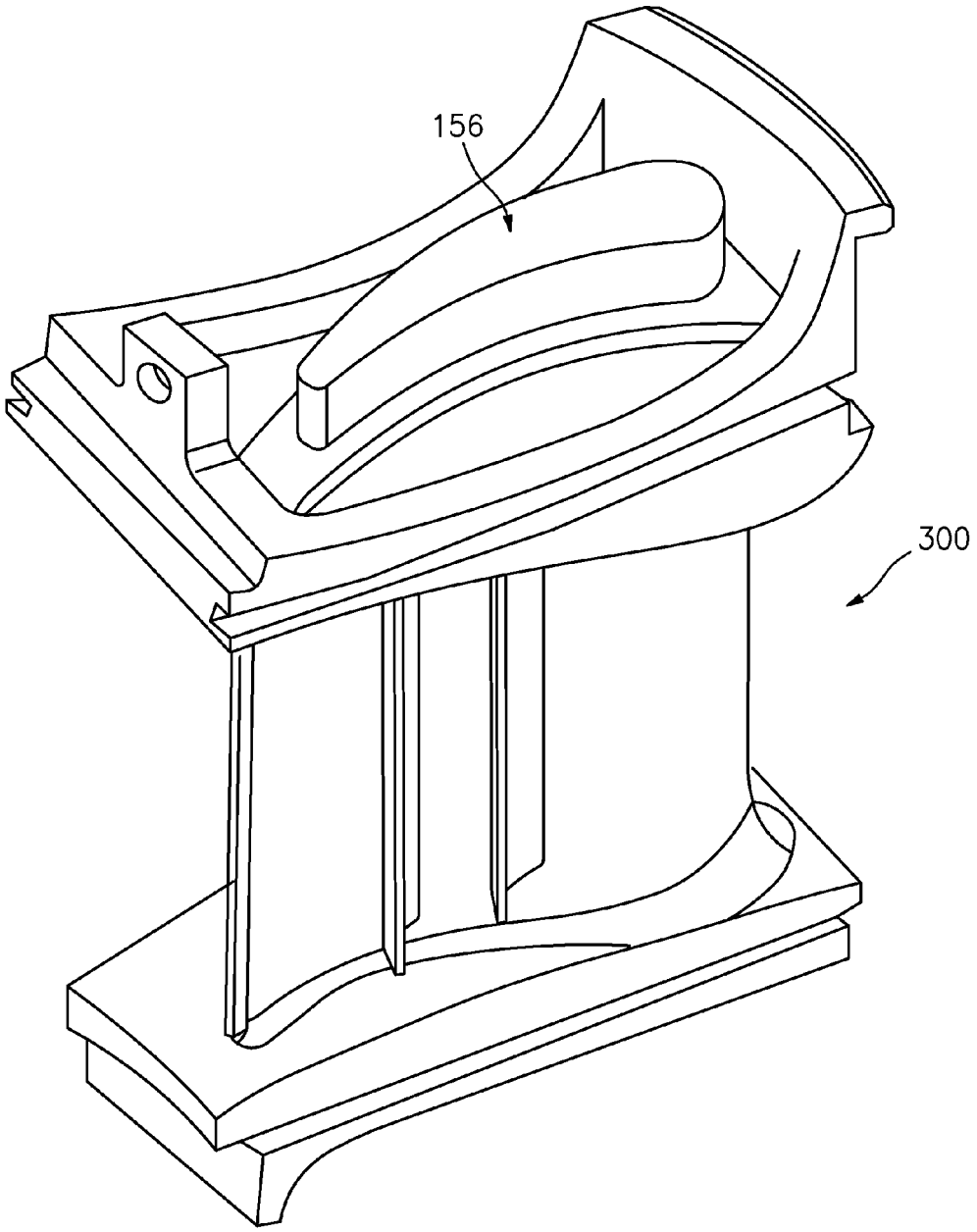
FIG. 7 is a view of a casting pattern for casting the vane of FIG. 2.
Figure 8:
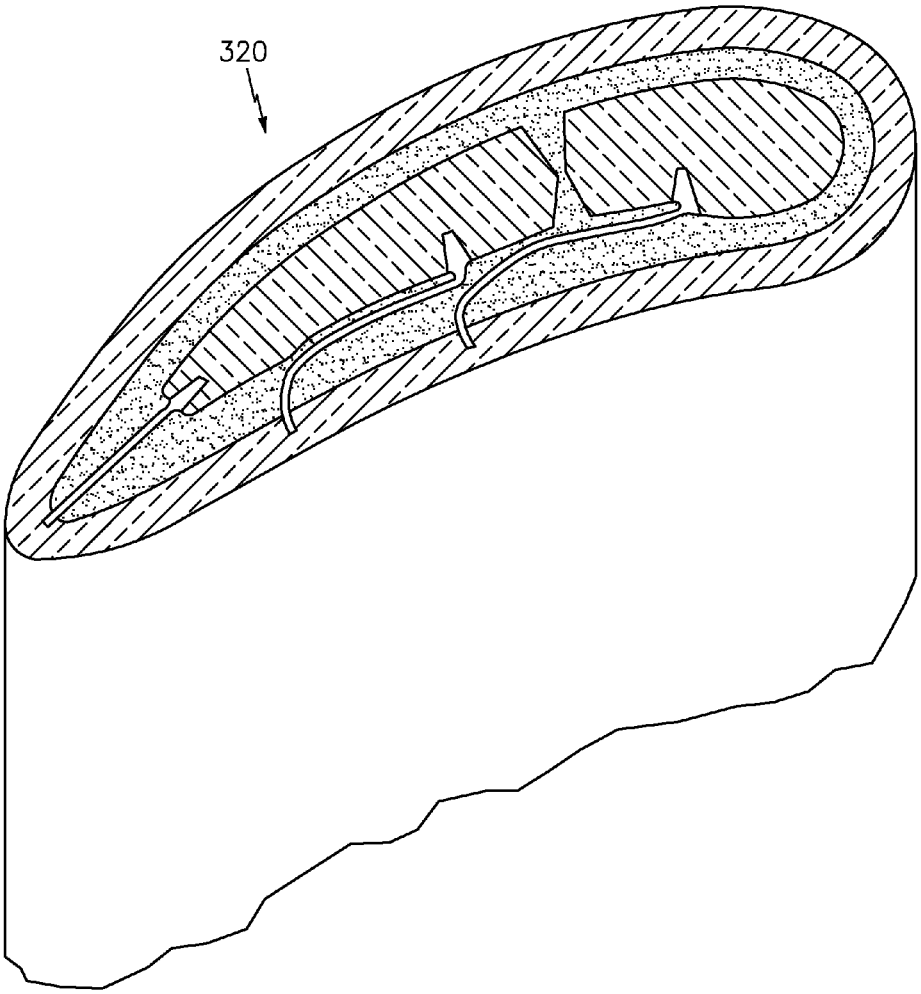
FIG. 8 is a cutaway view of the casting pattern post-shelling.

The overmolded core assembly (or group of assemblies) forms a casting pattern 300 (FIG. 7) with an exterior shape largely corresponding to the exterior shape of the part to be cast. The pattern may then be assembled to a shelling fixture (not shown, e.g., via wax welding between end plates of the fixture). The pattern may then be shelled (e.g., via one or more stages of slurry dipping, slurry spraying, or the like). After the shell 320 (FIG. 8) is built up, it may be dried. The drying provides the shell with at least sufficient strength or other physical integrity properties to permit subsequent processing. For example, the shell containing the core assembly may be disassembled fully or partially from the shelling fixture and then transferred to a dewaxer (e.g., a steam autoclave). In the dewaxer, a steam dewax process removes the wax leaving the core assembly secured within the shell. The shell and core assembly will largely form the ultimate mold. However, the dewax process typically leaves a residue on the shell interior and core assembly.

After the dewax, the shell may be transferred to a furnace (e.g., containing air or other oxidizing atmosphere) in which it is heated to strengthen the shell and remove any remaining wax residue (e.g., by vaporization) and/or converting hydrocarbon residue to carbon. Oxygen in the atmosphere reacts with the carbon to form carbon dioxide. Removal of the carbon may reduce or eliminate the formation of detrimental carbides in the metal casting. Removing carbon may reduce the potential for clogging the vacuum pumps used in subsequent stages of operation.

The mold may be removed from the atmospheric furnace, allowed to cool, and inspected. The mold may be seeded by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred to a casting furnace (e.g., placed atop a chill plate (not shown) in the furnace). The casting furnace may be pumped down to vacuum or charged with a non-oxidizing atmosphere (e.g., inert gas) to prevent oxidation of the casting alloy. The casting furnace is heated to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy may be poured into the mold and the mold is allowed to cool to solidify the alloy (e.g., after withdrawal from the furnace hot zone). After solidification, the vacuum may be broken and the chilled mold removed from the casting furnace. The shell may be removed in a deshelling process (e.g., mechanical breaking of the shell).

The core assembly is removed in a decoring process such as alkaline and/or acid leaching (e.g., to leave a cast article (e.g., a metallic precursor of the ultimate part)). The cast article may be machined, chemically and/or thermally treated and coated to form the ultimate part. Some or all of any machining or chemical or thermal treatment may be performed before the decoring.

Figure 9:
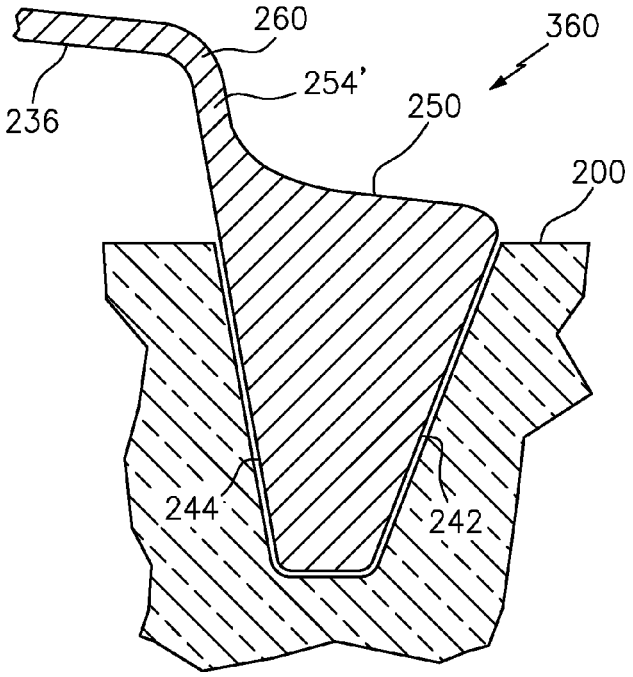
FIG. 9 is a sectional view of a joint including a first alternate RMC.

FIG. 9 shows an alternate RMC 360 wherein the neck 254' is not generally centered relative to the faces 242 and 244. Rather, it is shifted to eliminate the shoulder 252 and expand the shoulder 250. Thus, the transition between the plug face 244 and the face 236 along the main portion of the core does not involve a zigzag for the shoulder but may be a single turn in a single direction. Because this basically angles the surface 236 downstream along the neck 254', there is less turning in the flow through the resulting cast outlet passageways. Manufacturing considerations may be otherwise similar to the FIG. 6 RMC with the exemplary RMC being additively manufactured in final form. As with the other RMCs, alternative manufacture may involve a combination of additive manufacturing followed by bending (and hole drilling if holes are not pre-formed). Yet other manufacturing variations include machining of a blank (e.g., with the main body flat) followed by bending.

Figure 10:
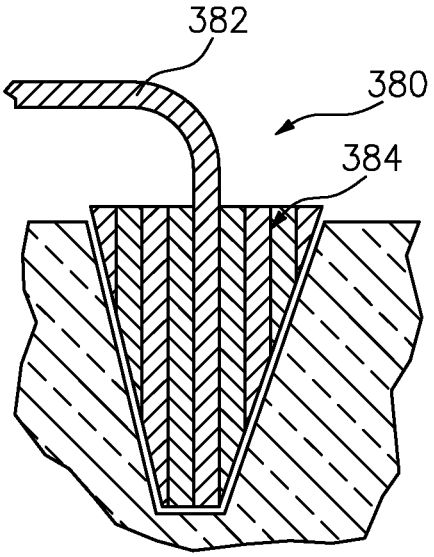
FIG. 10 is a sectional view of a joint including a second alternate RMC.

FIG. 10 shows a laminated RMC 380 generally dimensionally similar to those previously described. The RMC is formed from a laminate of sheets including at least one main sheet 382. The same refractory metals or alloys thereof may be used as were noted above. In this example, the main sheet forms the entire RMC outside of the plug 384. The plug 384 is formed by a stack of laminations of additional sheets. In the exemplary embodiment, each of these sheets may have thickness in the range discussed above for core main body thickness.

Figure 11:
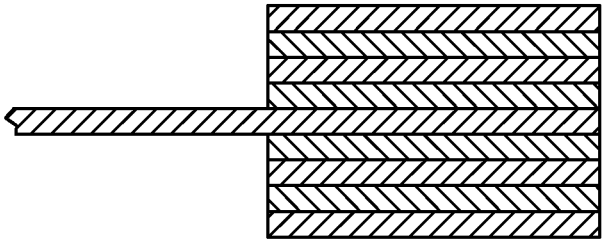
FIG. 11 is a sectional view of a precursor to the second alternate RMC.

FIG. 11 shows a precursor to the RMC 380 wherein stacks of sheets for forming a plug precursor have been secured at both faces of the main sheet at the inboard end thereof. An exemplary stack is essentially a right parallelepiped. The stack may be formed by cutting individual strips and applying them one-by-one via welding. Exemplary welding is tack welding. Depending upon the welding technique used, multiple sheets may be added and simultaneously welded.

Figure 12:
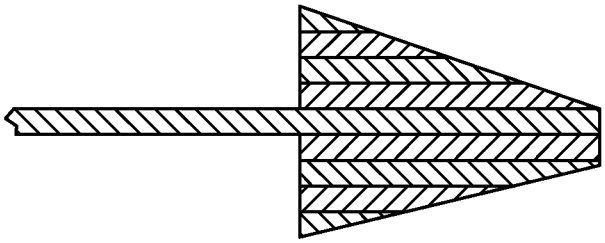
FIG. 12 is a sectional view of the FIG. 11 precursor post-machining.

FIG. 12 shows the results of a subsequent machining operation to taper the sides to leave plug geometry similar to that discussed above. As with the other RMC, there may be a subsequent bending and finally a coating. The apertures or other features in the RMC may be machined at any appropriate stage such as prior to lamination, post-lamination, simultaneous to plug machining, or post-plug machining.

Figure 13:
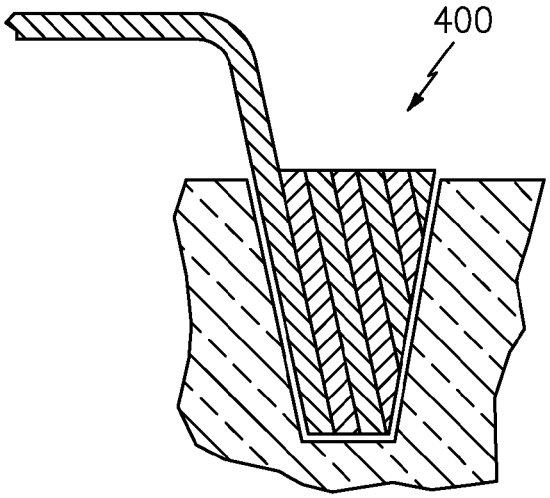
FIG. 13 is a sectional view of a third alternate RMC.
Figure 14:
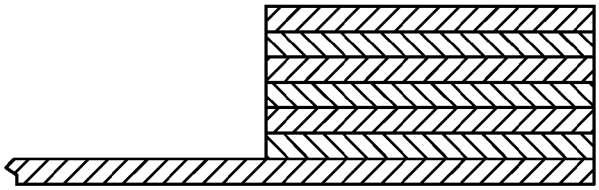
FIG. 14 is a sectional view of a precursor to the third alternate RMC.
Figure 15:
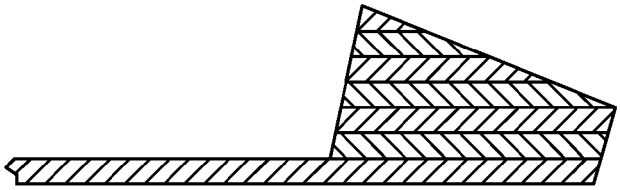
FIG. 15 is a sectional view of the FIG. 14 precursor post-machining.

FIGS. 13-15 show a sequence for manufacturing an RMC 400 manufactured by similar process to the RMC 380 but having a geometry generally similar to the RMC 360. In this case, the laminations are not applied symmetrically on either side of the main sheet. Rather, there is an asymmetrical application to shift and angle the RMC main sheet (and thus provide similar outlet passageway characteristics to those discussed for the RMC 360). In this particular example, all the plug laminations are applied to the side of the RMC which becomes the outward facing side rather than the feedcore-facing side.

One or more embodiments have been described. Nevertheless, it will be understood that various modifications may be made. For example, details of the particular components being manufactured will influence or dictate details (e.g., shapes, particular materials, particular processing parameters) of any particular implementation. Thus, other core combinations may be used. Accordingly, other embodiments are within the scope of the following claims.

What is claimed is:

1. A casting core assembly comprising:
a metallic core comprising:
a thickened portion comprising a metallic laminate; and
a thin portion extending from the thickened portion;
a ceramic core having a compartment in which the thickened portion is received; and
an adhesive joint between the thickened portion and the ceramic core.

2. The assembly of claim 1 wherein:
the adhesive joint is a ceramic adhesive joint between the thickened portion and the ceramic core.

3. The assembly of claim 1 wherein:
the ceramic core is an airfoil feedcore; and
the metallic core is an outlet core.

4. The assembly of claim 1 wherein:
the thickened portion is of increasing thickness from a proximal end toward a distal end.

5. The assembly of claim 1 wherein:
the thickened portion has flat first and second faces.

6. The assembly of claim 1 wherein:
a main sheet of the metallic laminate extends along both the thickened portion and the thin portion; and
a plurality of additional sheets of the metallic laminate extend only along the thickened portion.

7. A pattern comprising:
the assembly of claim 1;
a wax material in which the assembly is partially embedded.

8. A mold comprising:
the assembly of claim 1; and
a shell, the metallic core having a distal portion embedded in the shell and the metallic core spanning a gap between the ceramic core and the shell.

9. A process for forming the assembly of claim 1, the process comprising:
inserting the thickened portion of the metallic core into the compartment in the ceramic core.

10. The process of claim 9 further comprising:
securing the thickened portion to the ceramic core.

11. The process of claim 10 wherein:
the securing comprises introducing a ceramic adhesive between the thickened portion and the compartment.

12. The process of claim 10 wherein:
the securing comprises introducing a non-ceramic adhesive between the thickened portion and the compartment.

13. The process of claim 9 further comprising:
applying a coating to the metallic core.

14. The process of claim 9 further comprising:
forming the thickened portion by laminating a plurality of additional sheets to a main sheet.

15. The process of claim 14 wherein:
the laminating comprises welding.

16. The process of claim 14 wherein:
the plurality of additional sheets are asymmetrically applied to the main sheet.

17. The process of claim 14 wherein:
the plurality of additional sheets are symmetrically applied to the main sheet.

18. The process of claim 14 further comprising:
machining the laminated sheets.

19. The process of claim 9 further wherein:
the metallic core comprises a by-weight majority of one or more refractory metals.

20. The process of claim 9 being a portion of a pattern-forming process and further comprising:
overmolding a main pattern-forming material to the core assembly in a pattern-forming die.

21. A casting core assembly comprising:
a metallic core comprising:
a thickened portion comprising a metallic laminate and having flat first and second faces; and
a thin portion extending from the thickened portion, the first and second faces being not parallel and converging in a direction away from the direction in which the thin portion extends from the thickened portion; and a ceramic core having a pre-formed compartment in which the thickened portion is received.

22. A casting core assembly comprising:

a metallic core comprising:

a thickened portion comprising a metallic laminate and having first and second faces; and a thin portion extending from the thickened portion, the thin portion formed by a first sheet and the thickened portion comprising multiple stacked additional sheets on at least a first face of the first sheet;

a ceramic core having a pre-formed compartment in which the thickened portion is received and complementary in shape to the thickened portion; and an adhesive joint between the thickened portion and the ceramic core.

23. The casting core assembly of claim 22 wherein:

a face of the thickened portion is formed by a second face of the first sheet.

* * * * *